US010609992B2

(12) United States Patent
AlGhazi et al.

(10) Patent No.: US 10,609,992 B2
(45) Date of Patent: Apr. 7, 2020

(54) MOBILITY DEVICES HAVING SMART FEATURES AND CHARGING MOUNTS FOR SAME

(71) Applicant: CAN MOBILITIES, INC., Menlo Park, CA (US)

(72) Inventors: Ahmad AlSayed M. AlGhazi, Palo Alto, CA (US); Gadryn Higgs, San Mateo, CA (US); Osman Shawkat, Detroit, MI (US); Muhammad Alenzy, Miami, FL (US); Chris Tacklind, Menlo Park, CA (US); Abdullah Hejazi, Milpitas, CA (US); Jeffrey Schlosser, Menlo Park, CA (US)

(73) Assignee: CAN Mobilities, Inc., Menlo Park, CA (US)

( * ) Notice: Subject to any disclaimer, the term of this patent is extended or adjusted under 35 U.S.C. 154(b) by 0 days.

(21) Appl. No.: 16/095,201

(22) PCT Filed: Apr. 19, 2017

(86) PCT No.: PCT/US2017/028463
§ 371 (c)(1),
(2) Date: Oct. 19, 2018

(87) PCT Pub. No.: WO2017/184787
PCT Pub. Date: Oct. 26, 2017

(65) Prior Publication Data

US 2019/0142120 A1 May 16, 2019

Related U.S. Application Data

(60) Provisional application No. 62/324,853, filed on Apr. 19, 2016.

(51) Int. Cl.
*G08B 23/00* (2006.01)
*A45B 3/04* (2006.01)
(Continued)

(52) U.S. Cl.
CPC ..... *A45B 3/04* (2013.01); *A45B 3/00* (2013.01); *A45B 9/02* (2013.01); *A45B 9/04* (2013.01);
(Continued)

(58) Field of Classification Search
CPC ..... A45B 3/04
(Continued)

(56) References Cited

U.S. PATENT DOCUMENTS 4,562,850 A 1/1986 Earley et al.
5,097,856 A 3/1992 Chi-Sheng
(Continued)

FOREIGN PATENT DOCUMENTS

EP 1550488 A2 7/2005

OTHER PUBLICATIONS

CAN Mobilities, Inc., "The Smart Way to Keep Your Loved Ones Safe", CAN Mobilities (May 18, 2018), https://www.canmobilities.com/.

(Continued)

*Primary Examiner* — Tai T Nguyen
(74) *Attorney, Agent, or Firm* — Dorsey & Whitney LLP

(57) ABSTRACT

Examples described herein include mobility devices that may include a variety of enhanced features. For example, mobility devices are described which may more accurately assess a fall of a user by determining if a user is in proximity to a portion of the mobility device after a fall of the mobility device is detected. Examples of wall mounted chargers for mobility devices are also described. Moreover, examples of mechanisms for detaching and attaching tips to mobility devices (e.g. canes) are described which may facilitate swapping of different tips for different situations.

25 Claims, 7 Drawing Sheets

(51) Int. Cl.

| | |
|---|---|
| ***A45B 9/02*** | (2006.01) |
| ***A45B 9/04*** | (2006.01) |
| ***A45B 3/00*** | (2006.01) |
| ***G08B 21/04*** | (2006.01) |
| *A45B 9/00* | (2006.01) |

(52) U.S. Cl.
CPC ..... *G08B 21/043* (2013.01); *G08B 21/0461* (2013.01); *A45B 2009/002* (2013.01); *A45B 2009/007* (2013.01); *A45B 2009/025* (2013.01)

(58) Field of Classification Search
USPC ..... 340/500, 669, 531.13; 135/66; 600/300, 600/301, 306
See application file for complete search history.

(56) References Cited

U.S. PATENT DOCUMENTS

| | | | | |
|---|---|---|---|---|
| 5,318,057 | A | 6/1994 | Wallum | |
| 5,331,990 | A | 7/1994 | Hall et al. | |
| 5,582,196 | A | 12/1996 | Hae et al. | |
| 5,636,650 | A | 6/1997 | Kroeze | |
| 5,640,985 | A | 6/1997 | Snyder et al. | |
| D408,126 | S | 4/1999 | Hunnicutt et al. | |
| D411,343 | S | 6/1999 | Brightbill et al. | |
| 5,961,012 | A | 10/1999 | Bucher | |
| D417,068 | S | 11/1999 | Swercheck | |
| 6,000,414 | A | 12/1999 | Crusor | |
| 6,158,453 | A | 12/2000 | Nasco | |
| 6,163,249 | A | 12/2000 | Betcher, III et al. | |
| 6,170,500 | B1 | 1/2001 | Turechek | |
| D437,679 | S | 2/2001 | Lisowski et al. | |
| D552,340 | S | 10/2007 | Graves et al. | |
| D555,350 | S | 11/2007 | Graves et al. | |
| 7,540,296 | B2 | 6/2009 | Meyers et al. | |
| 7,600,523 | B1 | 10/2009 | Hawkesworth | |
| D620,696 | S | 8/2010 | Alacar, Jr. et al. | |
| D632,069 | S | 2/2011 | Thiessens | |
| 8,424,548 | B2 | 4/2013 | Willey | |
| D693,565 | S | 11/2013 | Chan | |
| D697,300 | S | 1/2014 | Alsaffar | |
| D698,140 | S | 1/2014 | Parker et al. | |
| 8,695,617 | B2 | 4/2014 | Diamond | |
| 9,226,555 | B1 | 1/2016 | Shyu | |
| 9,277,794 | B2 | 3/2016 | Moreau | |
| 9,596,912 | B2 | 3/2017 | Sacks | |
| D805,158 | S | 12/2017 | Pennington | |
| 9,852,600 | B1 * | 12/2017 | Yoon ..... | A45B 3/08 |
| D811,720 | S | 3/2018 | Crowhurst | |
| 10,016,032 | B1 | 7/2018 | Menn | |
| 10,136,841 | B2 | 11/2018 | Alghazi | |
| 2009/0056777 | A1 | 3/2009 | Lawhead et al. | |
| 2009/0174565 | A1 | 7/2009 | Chan et al. | |
| 2016/0253890 | A1 * | 9/2016 | Rabinowitz ..... | A61H 1/02 340/539.13 |
| 2017/0172462 | A1 | 6/2017 | Alghazi | |

OTHER PUBLICATIONS

Design U.S. Appl. No. 29,658,350, titled "Cane", filed Jul. 30, 2018.
International Search Report and Written Opinion for PCT Application No. PCT/US2017/028463, dated Sep. 7, 2017.
Invitation to Pay Additional Fees for PCT App No. PCT/US2017/028463 dated Jul. 12, 2017, p. 2-3.

* cited by examiner

MOBILITY DEVICES HAVING SMART FEATURES AND CHARGING MOUNTS FOR SAME

CROSS-REFERENCE TO RELATED APPLICATION(S)

This application is a 35 U.S.C. § 371 National Stage Application of PCT Application No. PCT/US2017/028463, filed Apr. 19, 2017, which claims the benefit under 35 U.S.C. § 119 of the earlier filing date of U.S. Provisional Application Ser. No. 62/324,853 filed Apr. 19, 2016, the entire contents of which are hereby incorporated by reference, in their entirety, for any purposes.

INCORPORATION BY REFERENCE

All publications and patent applications mentioned in this specification are herein incorporated by reference in their entirety to the same extent as if each individual publication or patent application was specifically and individually indicated to be incorporated by reference.

TECHNICAL FIELD

Examples described herein relate to enhanced capability mobility aid devices including processes by which a fall may be detected using such devices, wall mount chargers and tip locking mechanisms.

BACKGROUND

Mobility devices are finding increasing use in the elderly and/or those with mobility challenges. Moreover, accurately detecting when a user of a mobility device is in need of assistance (e.g. when a user has fallen) has proved challenging.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
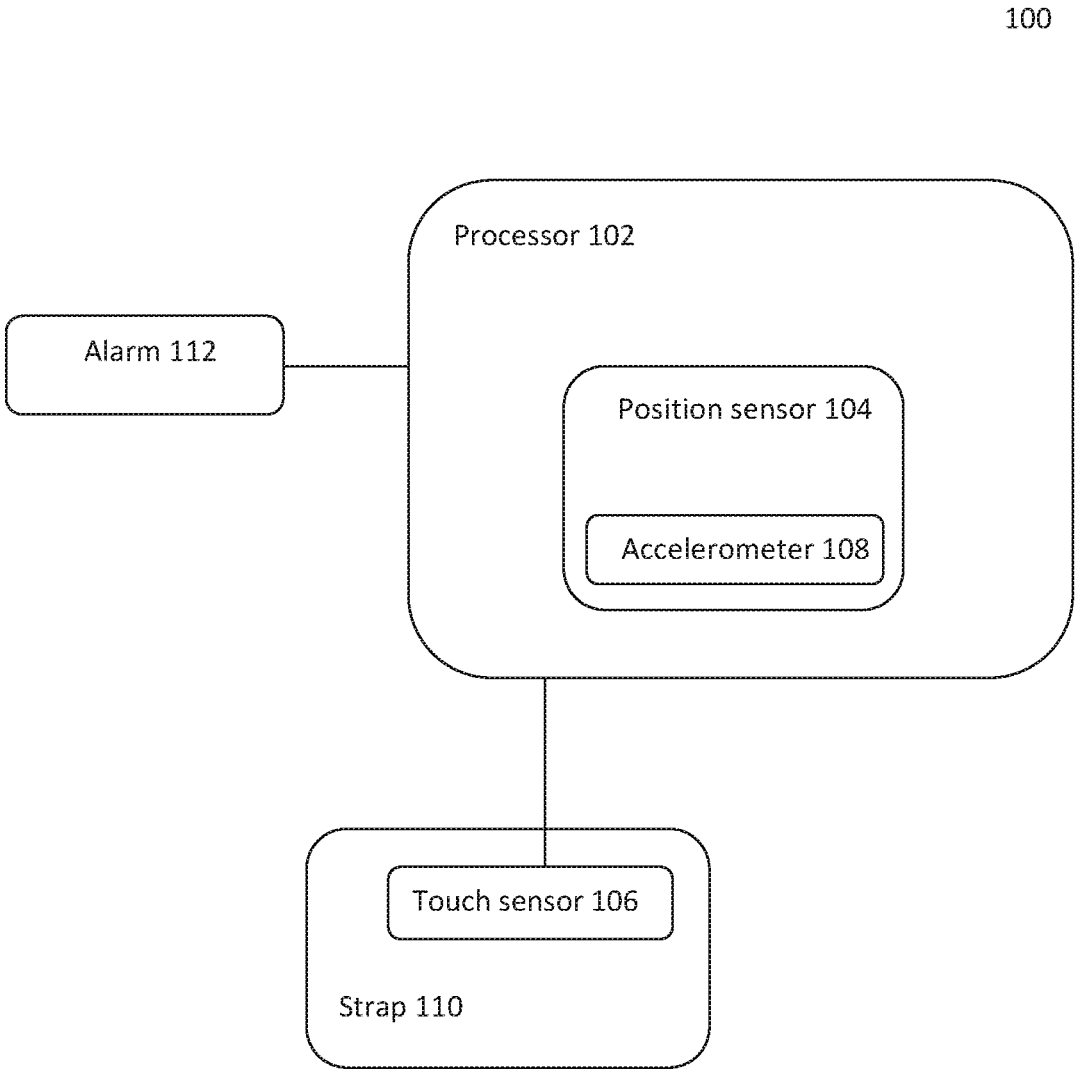
FIG. 1 illustrates a system embodiment including a processor coupled to an alarm and a strap.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein; and illustrated in the Figures, can be arranged, substituted, combined, separated, and designed in a wide variety of different configurations, all of which are implicitly contemplated herein.

Examples of mobility devices described herein may provide a wide array of functionalities. Generally, numerous embodiments of a multi-functional smart and connected mobility aid device are described herein where the device may have any combination of features as described herein. Such devices may help users to be more independent. Smart mobility aid devices described herein may have sensors to collect, monitor, analyze and/or represent data including but not limited to activity tracking, biometrics and safety and emergency features. The activity tracking may include tracking a number of steps, distance (e.g. miles), and/or activity speed, user applied pressure on a smart cane or other mobility device, activity types and/or analysis. The biometrics data may include but is not limited to blood work, blood pressure, blood sugar, heart rate, oxygen level/rate, ECG, EMG, muscle strain, humidity, UV, and/or body temperature. In some embodiments, the safety and emergency features may include an emergency button, fall detection and warning, and/or user activity pattern collection and analysis of activity pattern changes. In some embodiments, sensors may be placed on strap connected to a mobility device to collect and monitor data automatically. Also, there are smart mobility aid embodiments that include a medication management system that reminds and monitors a user medication schedule. The mobility device data may be represented in the form of visuals, sound/voice, and/or vibrations. The mobility device may be connected to other devices and/or the Internet using for example, Bluetooth, Wi-Fi, and/or SIM card. In addition, mobility devices may analyze how a user walks using the device and advise a user to improve his walking pattern, for example.

Any of a variety of mobility devices may be used to implement mobility devices described herein, including but not limited to, a wheelchair, a cane, a walker, a crutch, a scooter, a shoe, or combinations thereof.

In some embodiments, a strap may be provided that may be coupled to the mobility device. Multiple touch sensors may be arranged on the strap (e.g. on the interior of the strap), and the multiple touch sensors may be further coupled to a processor. The processor may be integrated with the mobility device (e.g. attached to and/or positioned within some portion of the mobility device, e.g. in the handle, seat, and/or other member of the mobility device). The processor may be coupled to (e.g, in electronic communication with) multiple touch sensors and a position sensor. The position sensor may be implemented, for example, using one or more gyroscopes, accelerometers, GPS devices, or combinations thereof. The processor may receive signals from the position sensor indicative of a fall of the mobility device. An alarm may be provided in response to the position signals indicative of the fall. In some examples, it may, however, be advantageous to improve fall detection by discerning whether or not a user has fallen together with the mobility device. For example, if a position sensor of the mobility device indicates a fall, it may be in some examples that the mobility device has simply fallen and then user may or may not have actually fallen. Accordingly, in some examples a fall alarm may only be provide when an indication is present that the user is still attached to the mobility device.

In some examples, mobility devices described herein may include a lock mechanism for interchanging tips on the mobility device—e.g. tips on a cane, for example. A variety of tips may be used for different situations—e.g. single-tip, dual-tip, tri-tip, quad-tip. Locking mechanisms described herein may have one or more guide grooves and one or more convex guide portions. Tips may have one or more buttons that are coupled to one or more locking hooks, and an extending shaft having one or more mating guide grooves.

In some examples, wall mounts for mobility devices may be provided. The wall mount may include a horizontal member coupled to a vertical member. The horizontal member may have a shaped end configured to receive a portion of the mobility device to stabilize the mobility device in when the device not in use. A holder having a convex portion coupled to the horizontal member may receive a charging cable and the shaped end of the horizontal member may provide stability to the mobility device while the mobility device is being charged.

FIG. 1 illustrates a system 100 including a processor 102 coupled to an alarm 112 and a strap 110 according to the present disclosure. The processor 102 may receive signals from a position sensor 104, touch sensor(s) 106, and an accelerometer 108. The processor 102, alarm 112, position sensor 104, touch sensor(s) 106, and accelerometer 108 may be attached to, positioned on, and/or integrated in a mobility device (e.g. a cane, walker, wheelchair, crutch, shoes, etc.). The position sensor 104 may sense a position of the mobility device. The accelerometer 108, for example, may be used to implement, wholly or partially, the position sensor 104. The accelerometer 108 may measure a speed or an acceleration of the mobility device, for example, when it is falling. A strap 110 may be used to determine a user's proximity to the mobility device. For example, the strap 110 may include one or more touch or other sensors which may determine a presence and/or proximity of a user. The strap 110 may sends signals to the processor 102 using the touch sensors 106. The processor 102 may send a signal to an alarm 112 when a fall is detected and the user is still attached to the mobility device (e.g. when the touch sensors indicate the user is touching and/or proximate the strap 110). The processor 102, the position sensor 104, and the accelerometer 108 may be integrated in a handle of the mobility device in some examples. While not shown in FIG. 1, the system 100 may include computer readable media (e.g. memory, storage) encoded with executable instructions. The computer readable media may be in electronic communication with the processor 102 and, when executed by the processor 102, the executable instructions may cause the system 100 and/or the processor 102 to perform functions described herein. Accordingly, the mobility device may in some examples include software and may be programmed to perform functionality described herein. While a processor 102 is discussed, it is to be understood that any number of processing units may be used, and custom circuitry may be used in lieu of or in addition to processor 102 in some examples.

The strap 110 may be physically attached to the mobility device in a detachable or un-detachable manner in various examples. The strap 110 may in some examples detach from the mobility device when a sufficient force is applied (e.g. when the mobility device falls away from the user, the user moves away from the mobility device, or combinations thereof). The touch sensors 106 may be arranged on the strap 110 (e.g. on an interior of the strap 110). The touch sensors 106 may periodically send touch signals to the 102. The processor 102 may determine that the user is not touching the strap when the strap is detached from the mobility device if touch sensors 106 send signals indicative of the user not being attached to the mobility device (e.g. an absence of signals from the touch sensors 106 in some examples).

The alarm 112 may communicate with another system (not shown). The another system may include a system that is remotely located from the mobility device. For example, the alarm 112 may initiate communication with a care provider, emergency contact, the mobility device user, or some other entity. The alarm 112 may initiate communication using, for example, messaging, Internet communication, email, phone, text, auditory, visual, and/or other signals.

In some examples, the user of the mobility device may carry a wireless connector (not shown), for example, a pendant or a receiver unit. Wireless signals from the wireless connector may be provided to the processor 102, e.g. through a receiver which may be included in system 100 in some examples. The receiver may be attached to and/or integrated with the mobility device. The wireless signals from the wireless connector may provide proximity information regarding a user. In some examples, proximity information may be inferred via wireless signals, for example, Wi-Fi and Bluetooth, between the strap 110 and the mobility device. The strap 110 and the wireless connector may assess motion and orientation of the user and/or the mobility device and communicate this information to the processor 102. The system may include a battery or other power source (not shown) to store energy and power some or all of the components described. The battery or other power source may be attached to and/or integrated with the mobility device. Power harvesting circuitry may in some examples be used to implement all or portions of the power source—for example solar, wind, thermal, vibrational, or other power harvesting from an environment may be used.

The strap 102 with touch sensors may be used to provide a variety of functionality. For example, signals from the touch sensors may be used to determine when to turn on and/or off various functionality of the mobility device (e.g. a display screen, voice command functionality, etc), because the touch sensors may indicate that a user is using the device and/or is proximate the device.

Figure 2:
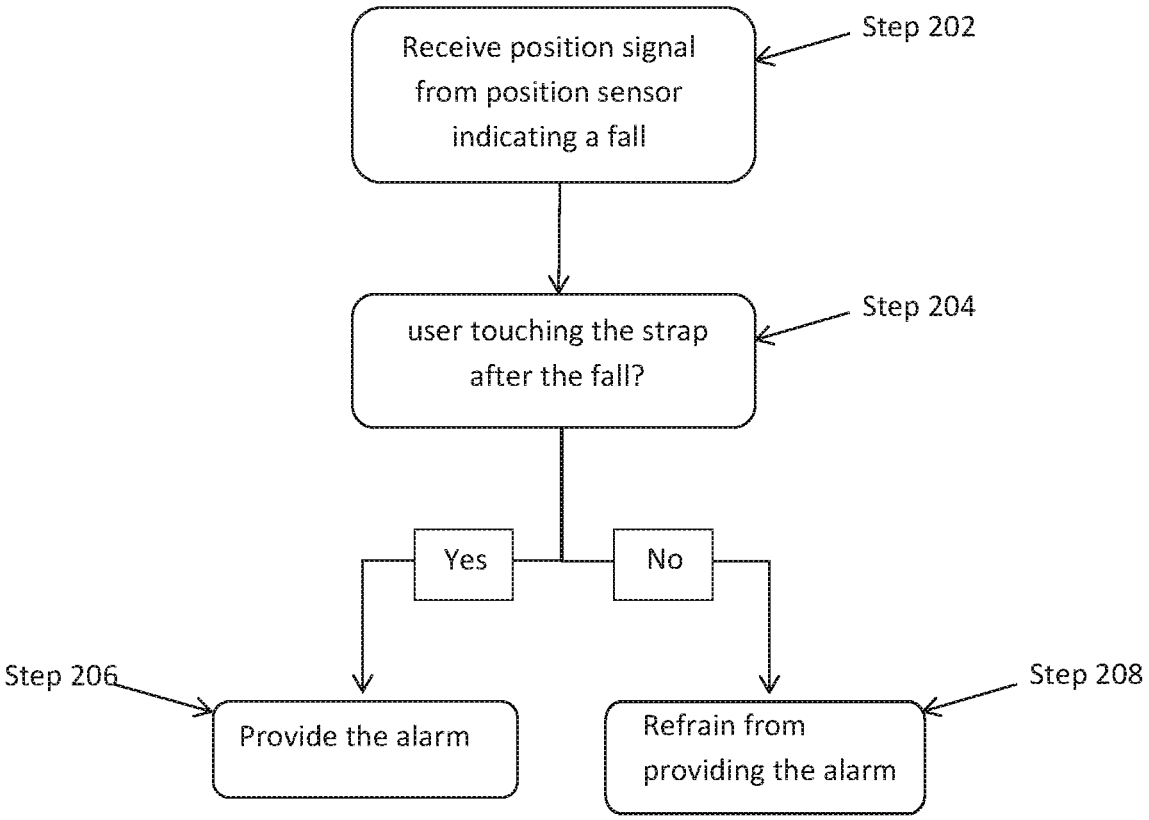
FIG. 2 is a flowchart illustrating an example system flow in which an alarm is provided responsive to received signals.

FIG. 2 is a flowchart illustrating an example method in which an alarm is provided responsive to received signals according to the present disclosure. In block 202, one or more position signals indicative of a fall is received from the position sensor 104. For example, accelerometer, gyroscope, and/or GPS signal may be received from the position sensor 104 which may indicate a fall. The processor 102 may analyze the signals and identify the fall (e.g. utilizing fall detection algorithm(s) programmed in the mobility device and/or in a system in communication with the mobility device). In block 204 the processor may evaluate whether the user is still touching the strap after the fall, for example, by analyzing signals received (e.g. the presence and/or absence of signals) from touch sensors on the strap. If it is determined that the user is still touching the strap after the fall in block 204, then the alai in is provided in block 206. The alarm may be sent to, for example, an emergency operator, a registered family member, or a registered care taker. If it is determined that the user is not touching the strap after the fall in block 204, then the alarm will not be provided as illustrated in block 208.

Figure 3:
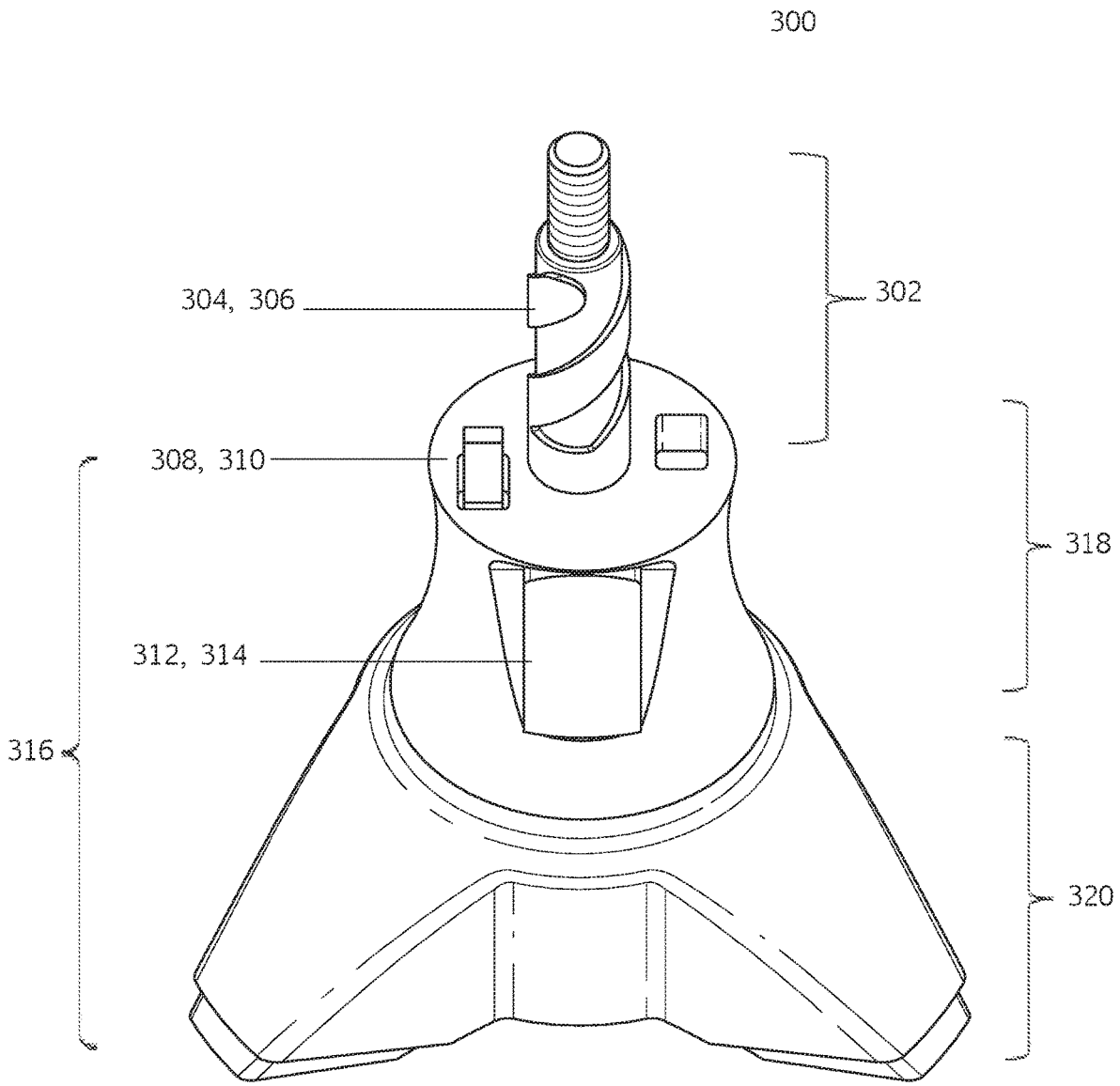
FIG. 3 illustrates an embodiment of a lock mechanism of a multi-functional smart mobility aid device.

FIG. 3 illustrates an embodiment of a lock mechanism 300 of a mobility device according to the present disclosure. The lock mechanism 300 may include an extending shaft 302, guide grooves 304 and 306, locking hooks 308 and 310, buttons 312 and 314, and a base 316. The base 316 may include an upper base 318 and a lower base 320. The extending shaft 302 houses the guide grooves 304 and 306. The mobility device houses mating guide grooves (not shown) configured to mate with the guide grooves 304 and 306. The extending shaft 302 is attached to the base 316. The base 316 houses buttons 312 and 314. The buttons 312 and 314 may activate the locking hooks 308 and 310. The buttons 312 and 314 are disposed on the exterior of the base 316. The locking hooks 308 and 310 may hook onto the matching receiving portion on the mobility device (e.g. an interior of a cane shaft), such that when the extending shaft 302 inserts into the mobility device along the mating groove, the mobility device is locked onto the base 316.

The base 316 may turn clockwise or counter-clockwise. The base 316 may attach to the mobility device, for example, a cane. The lock mechanism 300 may generally attach to any of a variety of mobility devices and/or also attach to devices or products that need easy lock-unlock mechanism, for example, a camera tripod. The mechanisms may be used to interchange base portions of a walker, for example (e.g. to change to/from a tennis/baseball base portion). The lock mechanism 300 may attach to and detach from the mobility device. The base 31 may house two or more locking hooks and buttons to provide additional safety features.

In this manner, a bottom end of example mobility device bodies may be designed in a way that allows an easy replacement process of the mobility device base. The base tip may be replaced based on user preference, the condition of the user and/or the environment that it will be used on for example. Any of a variety of tips may be used, including basic base, tripod base to make the mobility device self-standing, flexible, ice tip, etc.

Figure 4A:
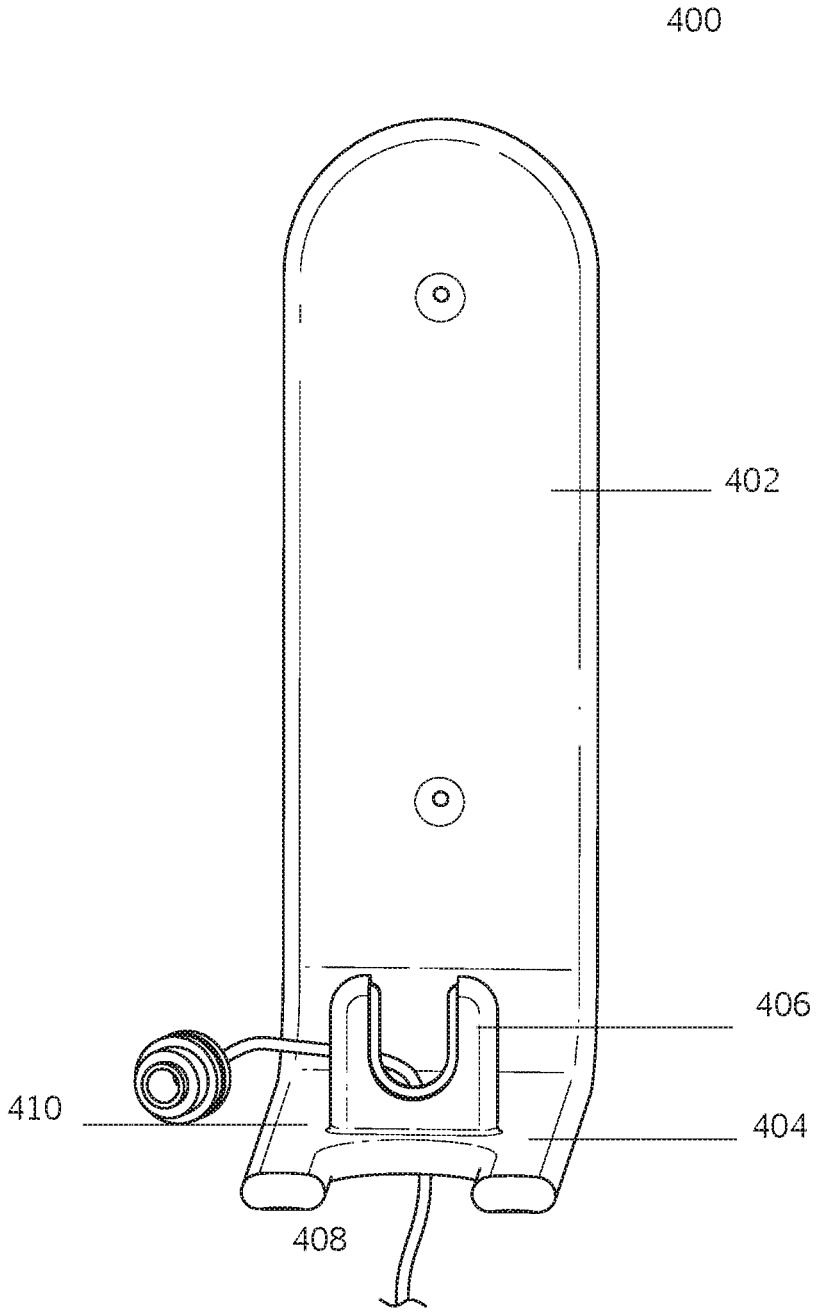
FIG. 4*a* illustrates an embodiment of a wall mount.

FIG. 4*a* illustrates one embodiment of a wall mount 400 according to the present disclosure which may be used to support and/or charge a mobility device. The wall mount 400 may include a vertical member 402, a horizontal member 404, a convex portion 406, and a holder 410. The vertical member 402 may be coupled to the horizontal member 404. The horizontal member 404 may have a shaped end portion 408, and the shaped end portion 408 may receive a portion of the mobility device to stabilize the mobility device when the device is not in use. The holder 410 may be coupled to the horizontal member 404 and may further receive a charging cable (not shown). The shaped end portion 408 stabilizes the mobility device such that a charging port of the mobility device may be aligned with the convex portion 406 to connect the charging cable.

The vertical member 402 may attach to a surface, such as using one or more nails, screws, adhesives, and/or Velcro®, The surface may, for example, be a wall. The vertical member 402 may have a dimple (not shown) to further provide support for the mobility device (e.g. into which a portion of a cane handle may rest).

Figure 4B:
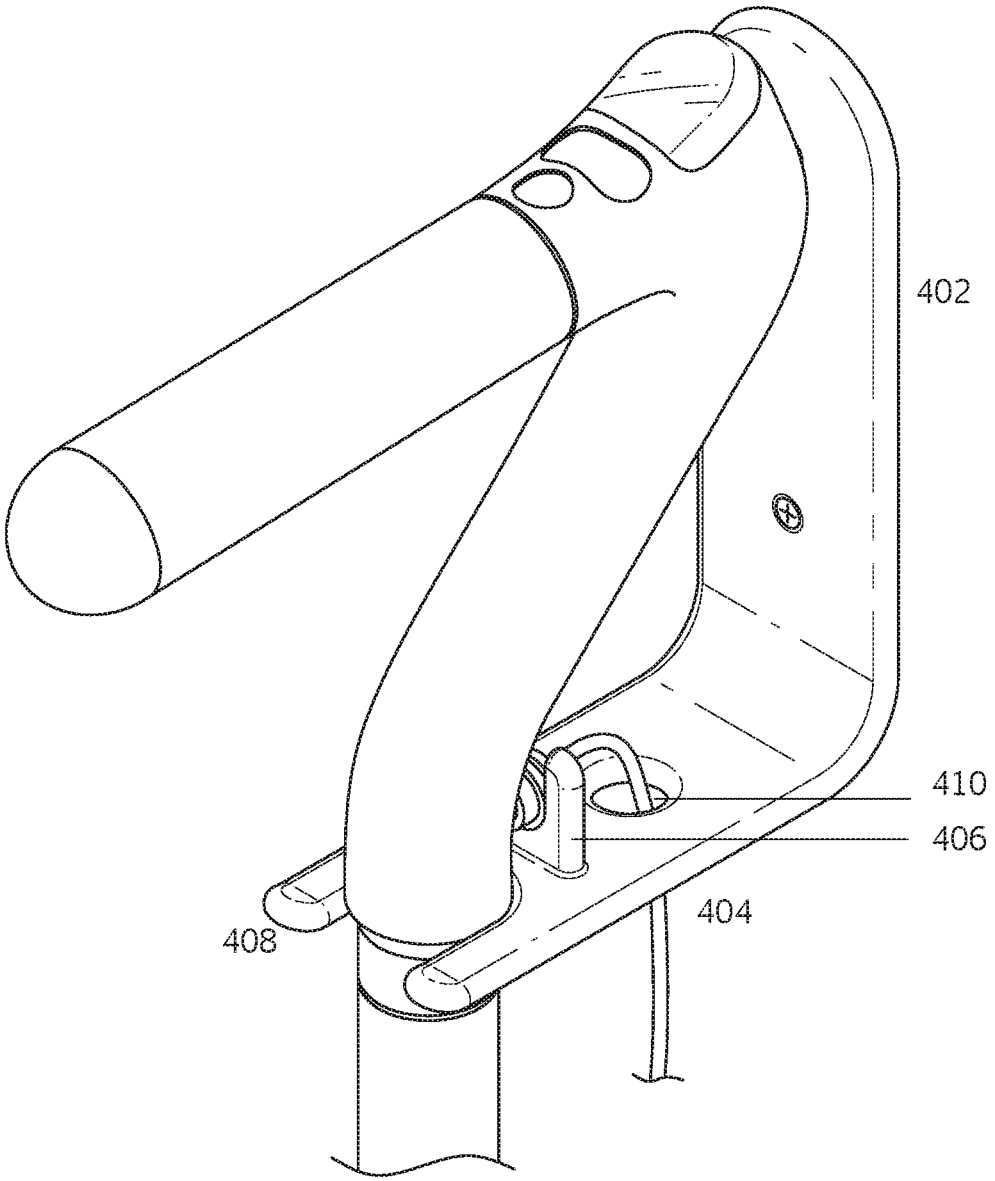
FIG. 4*b* illustrates a perspective view of the wall mount.

FIG. 4*b* illustrates a perspective view of the wall mount 400 with the shaped end portion 408 receiving a mobility device, for example a cane, according to the present disclosure. The shaped end portion 408 is receiving a narrow portion of the cane and an indent (not shown) the vertical member 402 may further provide support for the mobility device. In some embodiment, the holder 410 is coupled to the charging cable such that the convex portion 406 and the charging cable are aligned with the charging port of the mobility device.

Figure 5:
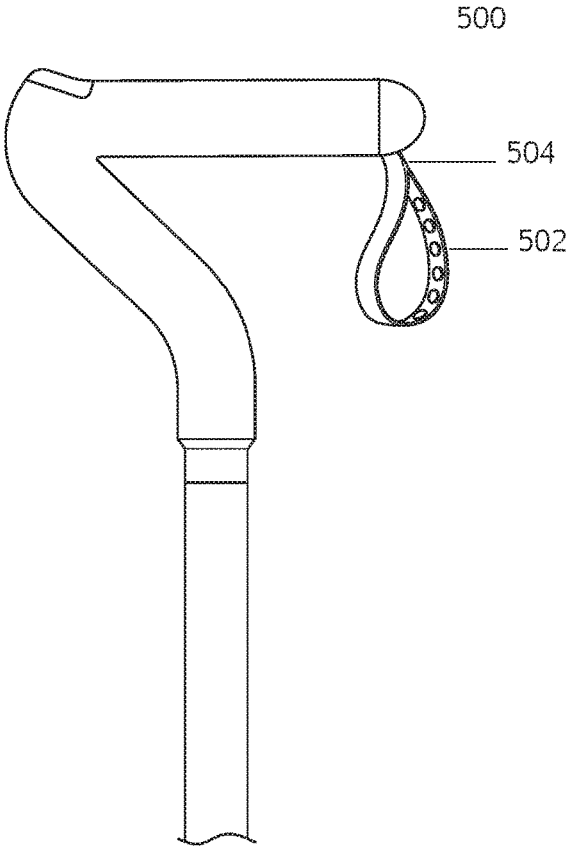
FIG. 5 illustrates an embodiment of a strap.

FIG. 5 illustrates one embodiment of a strap 500 according to the present disclosure. The strap 500 may include a plurality of sensors 502 and an attachment portion 504. The attachment portion 504 may attach to the mobility device at one end (e.g. at a handle of a cane or walker). The plurality of sensors 502 may connect to a user's body, for example, wrist, ankle, neck, and/or hand and collect user data. The strap 500 may be used to determine whether the strap 500 is connected to the user or not connected to the user (or proximate or not proximate the user). The strap 500 may detach itself from the mobility device when a sufficient force is applied. When a processor of the mobility device no longer receives signals indicative of user touch or a proximate user, the processor may determine that the user is no longer physically tethered to the mobility device.

The strap 500 may attach to the mobility device using non-physical connections, such as a wireless connector (not shown). Proximity of the user to the mobility device may be communicated from the strap 500 to the mobility device through wireless signals in some examples (e.g. using a transmitter on the strap and a receiver on the mobility device). The strap 500 may include a battery and/or other power source to store energy (not shown). When detachment of the strap 500 from the mobility device, or separation between the strap 500 and a wireless unit is detected, the strap 500 may activate a voice command feature or initiate a 2-way voice communication. The strap 500 may be used to detect user motions and, for example, confirm an increased likelihood that a user fell.

Figure 6:
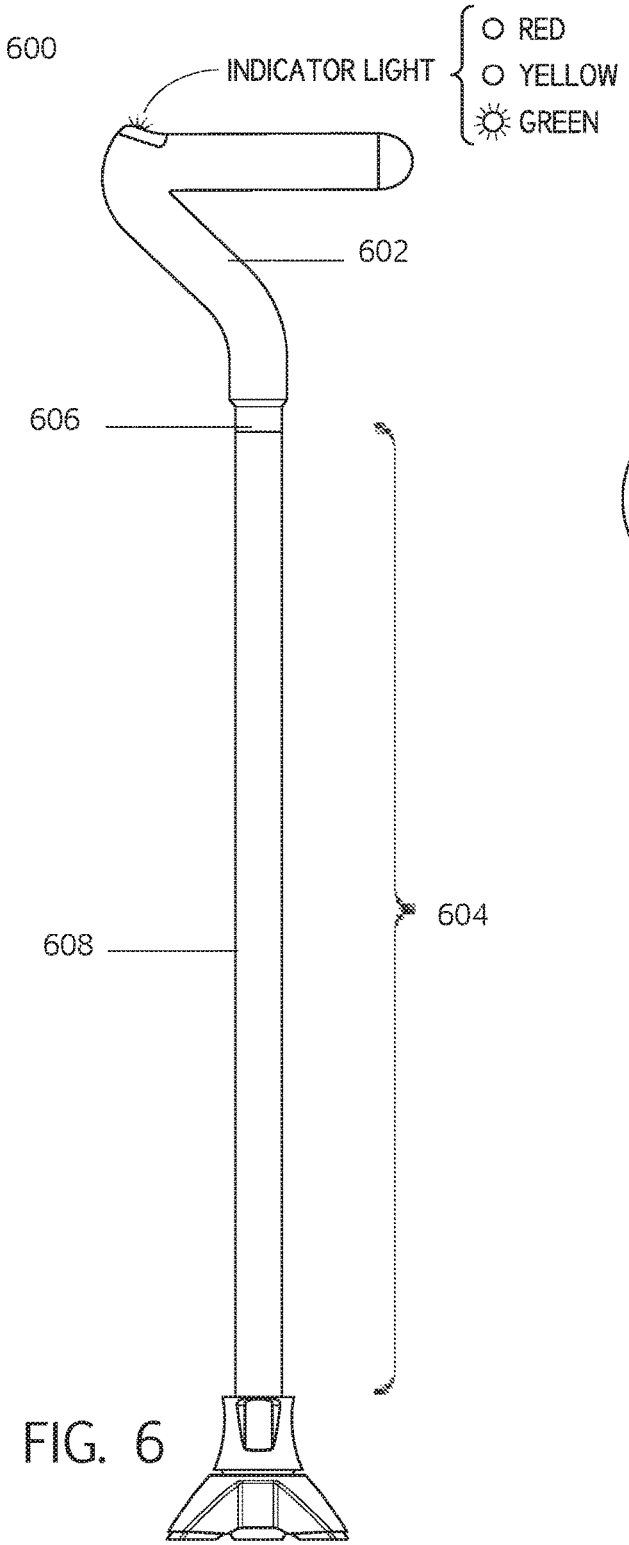
FIG. 6 illustrates an embodiment of the multi-functional smart mobility aid device.

FIG. 6 illustrates one embodiment of a mobility device, for example, a cane 600 according to the present disclosure. The cane 600 may have a handle 602, a narrow tubular portion 606, and a wide tubular portion 608. The shaped end portion 408 of the horizontal member 404 may receive the wide tubular portion 608. The handle 602 may have a charging port (not shown) that a charging cable may connect to. The charging port may be coupled to a battery or other power source of the mobility device. The charging port may further include a magnetic head such that the charging cable can snap into place. The handle 602 may also include different smart components, including but not limited to a plurality of health monitoring sensors (not shown). The plurality of health monitoring sensors placed in the handle 602 such that they can monitor the user's health parameters during a regular use of the multi-functional smart mobility aid device. The plurality of sensors may be configured to detect biometrics including but not limited to; blood work, blood pressure, blood sugar, heart rate, oxygen level/rate, ECG, EMG, muscle strain, humidity, UV, and/or body temperature. The plurality of sensors may include but are not limited to, gripping sensors, light sensors, fingerprint sensors, and/or GPS sensors. The handle 602 may include a status indicator, which may be implemented by, for example, light (e.g. LED), sound, vibration and/or visual (e.g. display).

The mobility device may further include a gyroscope, a MEMS magnetometer, a barometric pressure sensor, a temperature sensor, a microcontroller, flash memory, digital motion processor for sensor fusion management, motion processing library, and/or Bluetooth® low energy radio. The mobility device may be used to count the number of steps, distance (e.g. number of miles), type of activity, calories burned and based on the user weight it may provide the amount of calories burned. User weight may be determined by the user pressure on the cane, or by entering it on the cane screen or using smart devices such as a phone, a smart watch, a smart glass, and/or a tablet. The mobility device may give the users live feedback on their performance and give motivation to achieve goals in some examples. The mobility device may create games for users in some examples based on their own targets, and/or the mobility device may promote social gaming by comparing user results and/or assisting the user in competing with other people. The mobility device may further be used to train users to walk in the right way in some examples and advise them if they walk in an unhealthy way.

Figure 7:
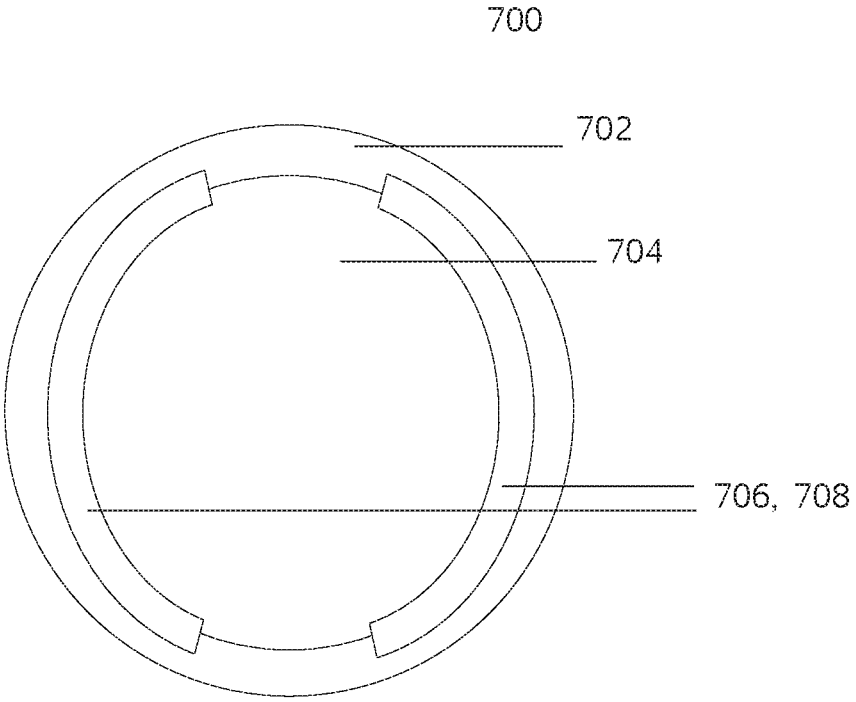
FIG. 7 illustrates an embodiment of a grip mechanism.

FIG. 7 illustrates one embodiment of a grip 700. The grip 700 may have an outer grip 702, an inner grip 704 and sensors 706 and 708. The outer grip 702 may be made of a material such as rubber, leather, foam, or generally any non-conductive material. The inner grip 704 may be made using a structural element such as plastic, metal or the like. The inner grip 704 may be solid or tubular. The sensors 706 and 708 may be implemented using a conductive material such as copper foil, copper sheet, wire, or the like. The sensors 706 and 708 may be connected to a touch sensor or the like that may measure capacitance between the sensors 706 and 708. The sensors 706 and 708 may be connected to ground or other reference voltage in some examples.

The sensors 706 and 708 may turn on or off the grip 700 by, for example, sensing a user touching the outer grip 702 and releasing the outer grip 702. The on or off state of the grip 700 may be indicated by, for example, a light, a vibration, or the like. In some examples, the grip 700 may also be tamed on without giving any user indication that the grip 700 has been turned on. The grip 700 may be turned off with a delay in some examples. The grip 700 may be attached to mobility devices including, but not limited to, canes or walkers, or other devices which may be gripped such as door knobs, levers, bicycles, appliances, etc. The sensors 706 and 708 may communicate to another sensor, including but not limited to, a motion sensor and a tilt sensor. In some examples, the release of the outer grip 702 in conjunction with a detection of a change in device orientation may be used to detect a critical event, for example, a fall. The grip 700 may also include other sensors such as, but not limited to, a switch or a touch sensor. In some examples, the sensors 706 and 708 may be able to distinguish a grip from a touch. The sensors 706 and 708 may be implemented using a conductive material, including but not limited to copper foil, copper sheet, or conductive wires. The conductive material may be covered with a non-conductive layer in some examples. The sensors 706 and 708 may adjust their sensitivities based on sequential reading of data over time.

Mobility devices described herein may be implemented using, for example, walkers, crutches, scooters, and/or wheelchairs. Mobility aid devices may further detect motions and gestures. Such motions and gestures may include, but are not limited step count, tap, activity detector, shake (n, direction), direction (x, y, z), rotation (degrees, direction), glyph detection, and/or swipe (direction). Mobility devices may also detect parameters including but not limited to; linear acceleration, heading, altitude, temperature, angular velocity, angular position.

In some examples, mobility devices described herein may include one or more features which may facilitate user independence in some examples. For example, utilizing the sensor capabilities, the mobility device may create a daily activity pattern of the user. If there is any unexpected change on the patterns, the mobility device may notify another system (e.g. a caregiver).

The mobility device may collect information about users' activities and may determine one or more patterns in the activity of a particular user, or groups of users. The mobility device may notify another system (e.g. a caregiver) if changes occur to the identified patterns (e.g. a change in a daily pattern).

In some examples, mobility devices may include an emergency button for a user to press to communicate with another system (e.g. one or more caregivers, and/or emergency personnel, such as by dialing 911). The communication may be in any of a variety of forms including, but not limited to, a phone call, app push notification, third parties, and/or website update.

In some examples, mobility devices described herein may alert users of natural disasters such as earthquake, tsunami, and/or high wind. For example, a receiver of the mobility device may receive one or more alerts, e.g. using a Wi-Fi connection, from one or more services, such as a weather service, or emergency broadcast service, such that the information regarding the disaster may be received by the mobility device and an alarm activated.

In some examples, mobility devices described herein may include pressure and/or motion sensors. Pressure sensors may be used, for example, to monitor user pressure on the mobility device. Pressure sensed may be used, for example, to help a user and/or other reviewer of the data to monitor the user's leg strength based on their pressure on the mobility device. In some examples, combining different metrics may allow the mobility device to provide advice for users regarding their rehab situation, their way of walking and how to improve it, and/or it can suggest using different mobility aid like a walker instead. The motion sensors in some examples may track user activities even if they are not using them, such as when sleeping, and may use the data to create and/or identify activity patterns.

Other features may be included in mobility devices described herein in some examples. For example, mobility devices may include one or more distance sensors (e.g. ultrasonic sensors) that may be used to warn users that objects and/or obstacles are approaching. For example, a warning may be provided in some examples when stairs, steps, and/or ledges are near.

In some examples, mobility devices may include a memory or other storage which saves past activities such as sounds, vibrations, and/or motions. The memory may be fire and explosion resistant in some examples.

In some examples, mobility devices may be integrated with mobile payment systems, which may allow the user to use the mobility device as a payment method rather than cash or credit.

In some examples, mobility devices may be used to aid in medication management. For example, mobility devices may alarm, notify, and/or remind users about their medication schedule. Reminders may be visual and/or auditory, such as voice reminders, vibration and/or data displayed on a screen. When the user takes the medication, the mobility device may be used to notify a caregiver or other third party. In some examples, users or third parties, caregivers and/or doctors may enter, manage, update and/or track a medication schedule. In some examples, mobility devices may communicate and connect to regular and/or smart medication containers.

Sensors and components described herein may be distributed into the body of mobility devices in some examples.

In some examples, mobility devices may have a low power lighting part or a glowing color that may glow in the dark or dim lighting. Such lighting may advantageously assist users in finding the mobility device in dark or dimly lit places and aid in allowing the user to grasp the mobility device in some examples.

Mobility devices may have a light that may be turned on automatically in a dark and/or dimly lit place (e.g. using a light sensor) and if the user is grabbing the handle.

In some examples, mobility devices may be folded to reduce their size. The mobility device may include a spring to allow it to automatically unfold when pressing an unfolding button. It can include a damper to make the unfolding motion smoother in some examples.

Mobility devices may in some examples be folded/unfolded automatically using a small light motor with a folding/unfolding mechanism. The folding/unfolding mechanism may include a small motor, rope mechanism with a spring. Folding and/or unfolding may be performed manually or automatically once the user holds the mobility device.

Example mobility devices may generate a sound to allow a user to identify its place. In addition or instead, example mobility devices may be located using a GPS system, for example using a cell phone.

In some examples, collected information and data may be presented and communicated to the user using, for example, a built-in screen/touch-screen and/or by voice or/and vibration or/and using a different electronic devices including but not limited to smart phones, smart watches or smart glasses.

In some examples, third parties such as caregiver or doctors may have live access to information collected by and/or stored by the mobility device. This may allow the third parties to take actions, give advice, help and/or interact with the user.

Example mobility devices may have a microphone and a speaker to allow a two-way communication with a third party (e.g. caregiver, a doctor, or an access to medical store services such as someone tells stories and talk to the user).

Data may be communicated in different forms including but not limited to visual, auditory, and/or vibratory.

In some examples, data collected by and/or stored at mobility devices described herein may be synced, transferred, updated and/or communicated using a low power communication such as Bluetooth and/or Wi-Fi technologies. Example mobility devices may include a SIM card or other storage to keep it connected outdoors. In some examples, the mobility device may directly connect to the user's smartphone or other electronic device without the need of a SIM card on the mobility device itself.

Example mobility devices (e.g. canes) may be connected to different devices. Users may have metrics on more than one device. For example, one mobility device (e.g. a cane) can communicate with one or more other mobility devices (e.g. walkers, crutches, shoes).

In some examples, data obtained from sensors described herein may be analyzed on the mobility device itself, on another electronic device, and/or in the cloud. The analysis may include predictive analysis that may lead to recommendations for users, caregivers or any other third party. In some examples, pattern visualization and data integration with third parties may be provided. Based on the data representation and analysis, the user, caregiver or/and the doctor may monitor, take actions and/or communicate with the user.

Examples of mobility devices described herein may have one or more power sources. Examples of power sources include a lightweight rechargeable lithium battery or a one time long-life battery that does not requires charging. In examples having rechargeable batteries, the user may only need to place the cane in an particular position (e.g. an upward position) on a charger (e.g. charging pad) to get charged. The mobility device may in some examples be charged wirelessly or by self plugged magnetic plug. In some examples, mobility devices described herein may have a self-charging mechanism generated by movements. In some examples, mobility devices may include a Li-ion-polymer battery charger and management via Micro-USB or a regular USB connection.

In some examples, an app store may be provided for mobility devices described herein. The app store may be a software platform where parties can develop apps and services to offer for users. For example, there may be an open API for developers to include additional features for mobility devices described herein.

In some examples, mobility devices described herein may be responsive to voice commands. Mobility devices may house a receiver that is capable of receiving and responding to voice commands. In some examples, voice command functionality may be kept dormant, by default, for battery savings. However, it may be activated in a variety of situations. By employing the built-in sensors and algorithms, the receiver may be able to detect when it or the user falls down. Once a fall is triggered, the voice commands feature may be activated.

In some examples, the voice command features may allow mobility devices described herein to detect certain pre-programmed and non-preprogrammed instructions. These may include both emergency instructions, such as, "Help", "I'm hurt", "I can't get up", "Call my daughter", "Get 911", "I need a doctor", etc. as well as non-emergency instructions, "I'm okay", "Turn on the lights", etc.

In the event of an emergency situation, the receiver may be able to automatically initiate 2-way voice communication with a pre-designated contact, e.g., family member, neighbor, caregiver, help-line, emergency services. The receiver may also be able to send location information, to provide the contact with their geographical location.

In some examples, mobility devices described herein may detect when a fall (device and/or user) occurs and may analyze the sequence of events leading up to a fall. Mobility devices described herein may detect imbalances in the user and even when a fall sequence is triggered. Additionally, mobility devices may determine when falls may have been avoided; that is, when a likely fall is triggered but does not occur. This information is collected and included in the user's fall risk assessment. An increasing number of falls avoided may suggest that the individual is becoming increasingly unstable and might need to modify their diet, medication, physical activity, or mobility-aid devices.

To detect when falls are triggered and occur or triggered and avoided, mobility devices described herein may utilize a combination of sensors, including load/force, grip, inertia, motion, position, slip, and/or orientation sensors.

In some examples, mobility devices described herein include an indicator light system. One or more indicator lights may provide qualitative and/or quantitative feedback about the user's physical activity and/or goals. In some examples, the lighting system may change colors based on the progression towards the user's personal or pre-programmed goals. The goals might be, for example, overall activity duration or distance traveled.

The indicator light system may include a single LED, or other type of light, or a series of lights. The system may emit a single color or be capable of multiple colors. As the user tracks towards their goals, the system might provide feedback through lighting intensity, color, or frequency.

This system might be used concurrently or independently from other quantitative feedback system(s). The lighting system might adjust periodically to compensate for user's activity and/or their goals.

In some examples, mobility devices may have a modular design where parts can be interchanged for similar or different parts. For example, in the case of a cane, the tips might be interchangeable (e.g., mono-tip, tri-tip, quad-tip). The interchangeable parts could communicate with other components described herein, so that the device is aware of the components connected. For example, a tip may store an identification of a type and/or function of the tip in, for example, a memory of the tip. When connected to the mobility device, the tip may provide the identification to one or more processor(s) of the mobility device, and/or the mobility device may query the memory of the tip to determine the identification.

The smart box is able to make recommendations to the user about what parts to use. Factors influencing this include extrinsic factors such as environmental conditions (e.g., rain, snow, ice, etc.) as well as intrinsic factors such as user's gait and balance. This recommendation may help the user maintain the optimal balance between security, stability, and mobility.

Example mobility devices described herein may include an image sensor and/or camera which may allow the mobility devices to observe the environment nearby the user. The imaging components may be able to detect obstacles and provide warnings to the user. Warnings may be provided of potential hazards—e.g. steps, changes in elevation, cracks or holes, rug edges, door slips, common areas that users might encounter that increase their risk of falling, etc.

The imaging technology might operate in the visible light range traditional camera), or infrared spectrum (e.g. thermographic camera).

Example proximity detectors might also use sonar, infrared, and/or another type of distance system. Proximity detectors may be capable of detecting distance and also other properties, such as temperature and/or density.

Example mobility devices described herein may also include an augmented/enhanced reality projection system. The mobility devices may utilize lighting to highlight potential hazards on the augmented/enhanced reality system directly. The augmented/enhanced reality system may also provide audio and tactile feedback to alert the user of one or more hazards.

Examples of cameras described herein may be accessed by third parties to see the environment around the user and have the ability to monitor or/and to give the user instructions, explanations, and/or turn by turn navigation (e.g. by voice or/and vibration) when desired—e.g. in case the device user is blind.

In some examples, mobility devices described herein may be battery operated and thus may have sensors and systems that may be inactive at times to save power. However, when charging, these systems may be fully activated. This may allow the mobility device to be responsive to voice commands from the user, as well as detect general safety alarms including, fire, carbon monoxide, burglary, etc. Example motion/proximity sensors may also be active when charging and could, for example, turn on the lights of the mobility device to help the user identify its location.

Examples of mobility devices described herein may contain an electronics board hosting the various sensors, processors, batteries, and/or other electronic devices. This electronic board may be strong enough to support the user's weight in some examples, or a portion of the user's weight. The board may be connected to the shell, which acts as a casing for cosmetic purposes and also for protection. The board might also be arranged in an orientation that allows it to maximize its strength based on directionality and alignment of the fibers in the board.

Example mobility devices described herein may include one or more smart buttons able to read biometrics directly from the user (e.g. from the user's fingers). Biometrics/vitals may be read non-invasively through skin contact of the user (e.g. finger). Biometrics which may be gathered include but are not limited to, heart rate, blood pressure, body temperature, respiratory rate, glucose, and/or perspiration. This information may be displayed directly to the user and/or uploaded to the cloud or other remote system for access by the user and/or third parties (e.g. caregivers). The smart button may be used in any device including but not limited to, mobility device, smart phone, watch, and/or laptop.

In some examples, mobility devices described herein may be able to confirm the user through various identity detection methods. Mobility devices may include user-recognition technology, such as a fingerprint reader, facial recognition, voice recognition, etc. These systems may distinguish fingerprints and/or vocal patterns. The fingerprint recognition system and/or voice recognition system may be embedded in the smart button and/or voice command system, respectively in some examples.

In some examples, mobility devices described herein may include a smart clock that could be viewed in the mobility device or any electronic device. The clock may update itself based on the location e.g. when traveling of the user or at any specific time of the year e.g. time saving in the US. The clock may be powered from the power source used to power the electronic device, an independent battery including but not limited to RTC batteries, solar cell or/and power generated by physical movement, for example, walking with the cane, walker or a shoe. The clock could be presented in different formats, in numbers, dots, shapes or voice. In some examples, the clock may be positioned such that the user could see the time while holding the mobility device or it could be hidden while the device is held.

Example mobility devices described herein may differentiate between pressing a button after a fall or not. Example mobility devices may determine a fall using one or more metrics including but not limited to device orientation, device shock, device acceleration, device rotation, etc. One of the methods to identify that is by first identifying a device drop (fail) or not. If the device detects that it was dropped, then the user press a button while being in the same position or a slightly different one, the help request or the notification will be treated as a fall. That could result on initiating a phone call, calling 911, testing, sending data, email, overdata call message or notification, turning on an alarm, etc. If the user presses the button and the device has not been dropped (e.g. no fall has been detected), the button could initiate, for example, a non-emergency phone call to a family member, sending a non-emergency text, email, or cause a control signal to be transmitted to another device (e.g. turn lights on/off, turn television on/off). In this manner, the button may cause one action after a fall event (e.g. cause an emergency alert) and another action when no fall event is detected (e.g., non-emergency communication or control of another device). This method could be implemented in any mobility device—e.g. a cane, a walker, a watch, a shoe, a wheelchair or any other devices. This method could be implemented using any kind of triggers including but not limited to pressing a physical button, pulling a cord, waving, voice, saying words, e.g. help, changing in ambient light, noise or temperature or any other input.

In some examples, mobility devices described herein may be adjustable. Mobility devices may be adjusted manually using a height adjustment mechanism or automated using motors. Mobility devices, e.g. canes, may adjust to the height of the user based on user height automatically by measuring the height of the user and changing itself to the optimal height. The mobility device may measure user metrics such as height, using one or more sensors such as radar, laser, etc., and change the height to fit the user. The adjustability could be done mechanically, e.g. by a button release mechanism. The one or more buttons could be located on a cane handle, on the shaft, or on the tip. The user can change the height of the cane in some examples by pressing one or more buttons that releases a pressure element of shafts. The buttons could trigger a small motor to pressure or release the pressure to accomplish locking or unlocking the height adjustment mechanism. In some examples, mobility devices described herein may locate themselves indoors accurately, such as, —by communicating to one or more beacons (e.g. .transceivers) placed in one or more predefined locations using different wireless and/or radio technology such as Bluetooth®, ZigBee®, Wi-Fi, etc. In this manner, the mobility device may identify if the user in a specific room, or a specific table, or even a specific chair. This may advantageously be used inside malls, airports, hospitals, houses, or senior communities.

What is claimed is:

1. An apparatus comprising:

a position sensor configured to sense a position of a mobility device;

a strap coupled to the mobility device;

a plurality of touch sensors arranged on an interior of the strap;

a processor coupled to the plurality of touch sensors and the position sensor, wherein the processor is configured to:

receive position signals from the position sensor indicative of a fall of the mobility device;

provide an alarm responsive to the position signals indicative of the fall when touch signals received from the plurality of touch sensors indicate a user of the mobility device is touching the strap after the fall of the mobility device; and refrain from providing an alarm responsive to the position signals indicative of the fall when the touch signals received from the plurality of touch sensors indicate the user of the mobility device is not touching the strap after the fall.

2. The apparatus of claim 1, wherein the strap is configured to detach from the mobility device, and wherein the touch signals received from the plurality of touch sensors indicate the user of the mobility device is not touching the strap when the strap is detached from the mobility device.

3. The apparatus of claim 1, wherein the strap is attached to the mobility device in an un-detachable manner and wherein the touch signals received from the plurality of touch sensors indicate the user of the mobility device is not touching the strap when the user has removed a portion of their body from the strap.

4. The apparatus of claim 1, wherein the mobility device comprises a cane and wherein the processor and the position sensor are integrated in a handle of the cane.

5. The apparatus of claim 4, further comprising a mobility device tip removably coupled to the mobility device.

6. The apparatus of claim 5, wherein the mobility device has one or more guide grooves and one or more convex guide portions, and wherein the mobility device tip comprises a shaft comprising one or more mating guide grooves configured to mate with the one or more guide grooves of the mobility device for coupling the mobility device tip to the mobility device.

7. The apparatus of claim 6, wherein the extending shaft is configured for insertion in an interior of the cane.

8. The apparatus of claim 6, further comprising a hook for securing the mobility device tip to the mobility device.

9. The apparatus of claim 5, wherein the mobility device tip is configured to attach at an end of the cane opposite from the handle.

10. The apparatus of claim 1, wherein the alarm comprises a communication to another system, wherein the another system is remote from the mobility device.

11. The apparatus of claim 1, wherein the alarm comprises an attempted two-way communication with the user.

12. The apparatus of claim 1, wherein the position sensor comprises an accelerometer.

13. The apparatus of claim 1 further comprising a grip having an outer grip, an inner grip and a plurality of sensors coupled to the inner grip, and wherein the processor is further configured to turn on a mobility device responsive to signals received from the plurality of sensors on the inner grip which indicate a detection of a force applied on the grip.

14. The apparatus of claim 13, wherein the processor is further configured to turn off the mobility device responsive to signals received from the plurality of sensors on the inner grip which indicate lack of applied force being detected from the grip.

15. The apparatus of claim 13, wherein the outer grip comprises a non-conductive material.

16. The apparatus of claim 1, further comprising a button operatively coupled to the processor, and wherein the processor is further configured, responsive to activation of the button, to perform a first act when a fall has not been detected and perform a second act when a fall has been detected.

17. The apparatus of claim 16, wherein the first act is to call a non-emergency number, and wherein the second act is to call an emergency number.

18. The apparatus of claim 17, wherein the first act further includes sending a non-emergency text or e-mail.

19. The apparatus of claim 18, wherein the second act further includes sending an emergency text or e-mail.

20. A system comprising the apparatus of claim 1, wherein the mobility device is a cane, the system further comprising a wall mount for the cane.

21. The system of claim 20, wherein the wall mount comprises a first member configured to attach to a wall surface, a second member extending from the first member and away from the wall surface when the first member is attached to the wall surface, and wherein the second member comprises a recess configured to receive the cane at least partially therein to support the cane on the wall surface.

22. The system of claim 21, wherein the wall mount further comprises a charging mechanism for charging the cane when the cane is coupled to the wall mount.

23. The system of claim 22, wherein the charging mechanism includes a charging cable.

24. The system of claim 23, wherein the wall mount further comprises a holder that supports the charging cable in a position in which the charging cable is aligned with a charging port of the cane when the cane is coupled to the wall mount.

25. The system of claim 20, wherein the wall mount is configured to position the cane with a grip of the cane facing away from the wall surface.

* * * * *